US007193587B2

(12) United States Patent
Yu et al.

(10) Patent No.: US 7,193,587 B2
(45) **Date of Patent: *Mar. 20, 2007**

(54) PLASMA DISPLAY PANEL WITH COLOR SPACE TRANSFORMATION DEVICE

(75) Inventors: Yi-Sheng Yu, Taoyuan (TW); Hsu-Pin Kao, Ping Chen (TW); Yi-Chia Shan, Chung Li (TW); Ching-Hui Lin, Taoyuan (TW)

(73) Assignee: Chunghwa Picture Tubes, Ltd. (TW)

( * ) Notice: Subject to any disclaimer, the term of this patent is extended or adjusted under 35 U.S.C. 154(b) by 639 days.

This patent is subject to a terminal disclaimer.

(21) Appl. No.: 10/664,886

(22) Filed: Sep. 22, 2003

(65) Prior Publication Data

US 2004/0145590 A1 Jul. 29, 2004

(30) Foreign Application Priority Data

Jan. 29, 2003 (TW) ..... 92102057 A

(51) Int. Cl.
*G09G 3/28* (2006.01)

(52) U.S. Cl. ..... 345/63; 345/60; 345/690; 315/169.1

(58) Field of Classification Search ..... 345/60, 345/690, 63; 315/169.1
See application file for complete search history.

(56) References Cited

U.S. PATENT DOCUMENTS 5,856,823 A * 1/1999 Kimoto et al. ..... 345/600
5,943,032 A * 8/1999 Nagaoka et al. ..... 345/63
6,473,061 B1 * 10/2002 Lim et al. ..... 345/60
6,693,609 B2 * 2/2004 Lee et al. ..... 345/63

* cited by examiner

*Primary Examiner*—Richard Hjerpe
*Assistant Examiner*—Leonid Shapiro

(57) ABSTRACT

A plasma display panel with color space transformation device is described. The plasma display panel with color space transformation device has a digital board, a display control circuit and a color plasma display panel. The digital board has a color space transformation device to transform the color space of the color plasma display panel into a new color space according to a video specification of images or into a new color space according to a user requirement. The digital board further modifies the images to fit the new color space. The color plasma display panel shows the modified images in the new color space.

20 Claims, 4 Drawing Sheets

PLASMA DISPLAY PANEL WITH COLOR SPACE TRANSFORMATION DEVICE

FIELD OF THE INVENTION

The present invention relates to a color space transformation method for a plasma display panel and especially to a plasma display panel with a color space transformation device.

BACKGROUND OF THE INVENTION

Conventional cathode ray tube (CRT) displays are unsuitable for use in multimedia applications because of their large volume. Therefore, many flat panel display techniques such as liquid crystal display (LCD), plasma display panel (PDP), and field emission display (FED) have been recently developed. These display techniques can manufacture a thin, light, short and small monitor, and thus these techniques are and will be the mainstream technology. In these techniques, the plasma display panel (PDP) is attracting attention in the field of displays as a full-color display apparatus having a large size display area and is especially popularly utilized in large-size televisions or outdoor display panels. This is because it is a high quality display as a result of it being a self-light emitting type with a wide angle of visibility and high speed of response as well as being suited to upsizing due to a simple manufacturing process.

A color PDP is a display in which ultraviolet rays are produced by gas discharge to excite phosphorus so that visible light is emitted therefrom to perform a display operation. Depending upon a discharge mode, the color PDP is classified as an alternating current (AC) or a direct current (DC) type. In the AC-type PDP, an electrode is covered with a protective layer. The AC-type PDP has inherent characteristics of long life and high brightness. Therefore, the AC-type PDP is generally superior to the DC-type PDP in luminance, luminous efficiency and lifetime.

PDP utilizes an external voltage to cause gas discharge inside the panel to produce the ultraviolet rays. The ultraviolet rays excite R, G, and B phosphorus to generate the visible R, G, and B lights. Therefore, the reddish orange color light caused by the gas discharge and the chromaticity purity of R, G, and B phosphorus apparently influences the output color of the PDP module. A good white balance of the PDP module is very important to produce a good color display so the balance of fudamental colors emitted by the R, G, and B phosphorus is important. However, even if a surface filter of the PDP module can filter the reddish orange color and modify the chromaticity of the PDP output, the color space of the PDP module still is different from the color space of the video specification, such as National Television System Committee (NTSC), European Broadcasting Union (EBU) or Standard RGB (sRGB). If there is not sufficient color space transformation, the output color of the PDP module may display visible color deviation. For example, the sky may be too green and a white cloud may be too yellow in a conventional PDP module. In particular, if the image quality is very bad, skin color may become too red or too green when the video specification of the PDP module and the video image signals are different.

FIG. 1 illustrates various video specifications in a CIE 1931 chromaticity diagram. The CIE 1931 chromaticity diagram is an international chromaticity system provided by the Commission Internationale de I'Eclairage (CIE) in 1931 and is well known to persons skilled in the art. Referring to FIG. 1, region 110 illustrates a color space of PDP module image output. Region 120 illustrates a color space of PDP module image output with a surface filter. Region 130 illustrates a color space of NTSC image output specification.

Region 140 illustrates a color space of EBU image output specification. Because all regions 110, 120, 130, and 140 do not fully overlap, the PDP video image output cannot fully satisfy these video specification requirements. Therefore, the PDP image output has to be modified to satisfy the respective video specification requirement according to the color space thereof. Otherwise, the image output may cause some color deviation.

A conventional PDP utilizes a Capsulated Color Filter (CCF) to adjust the color space of the video image output, but the CCF still demonstrates some color deviation to the video specification due to limitation of the filter material. Furthermore, the CCF still is expensive and complicated to manufacture and therefore the manufacturing process is very difficult and the yield rate is low. Additionally, even a PDP with CCF still cannot fulfill every different video specification requirement.

SUMMARY OF THE INVENTION

One object of the present invention is to provide a plasma display panel with a color space transformation device to reduce the color deviation problem and satisfy different video specification requirement and therefore display an accurate image with correct color output.

Another object of the present invention is to provide a color space transformation method for the plasma display panel effectively to transform the output color space of the PDP and deal with the output image thereof.

The present invention provides a plasma display panel with a color space transformation device. The plasma display panel comprises a digital board, a display control circuit, and a color plasma display panel. The digital board comprises a color space transformation device to receive image display signals and process the image display signals. The color space transformation device transforms a color space of the plasma display panel into a transformed color space of the plasma display panel according to a specification of the image display signals and transforms the image display signals into transformed image display signals according to the transformed color space of the plasma display panel. The display control circuit receives the transformed image display signals and generates control signals. The color plasma display panel receives the control signals and the transformed image display signals, and displays the transformed image display signals on the color plasma display panel in the transformed color space according to the control signals.

The digital board further comprises a microprocessor unit and an image processor. The microprocessor unit receives a user selection signal and issues a request to change the color space of the plasma display panel according to the user selection signal. The image processor receives the request and the image display signals and transfer the request and the image display signals to the color space transformation device. The digital board further comprises a de-contouring processing device to process the transformed image display signals with an error diffusion method to enhance the resolution of the transformed image display signals.

The specification of the image display signals comprises a National Television System Committee (NTSC) specification, a European Broadcasting Union (EBU) specification, an sRGB specification or any other predetermined specification. The display control circuit further comprises a scan sustainer, a scan driver integrated circuit, and a bulk sustainer to control the color plasma display panel, and further comprises a data driver integrated circuit to receive the transformed image display signals and transmit to the color plasma display panel. The digital board further comprises a timing controller to provide timing signals for the digital board and the display control circuit. The color plasma display panel further comprises a surface filter to filter a reddish orange light generated by a gas discharge.

Another aspect of the present invention is to provide a color space transformation method. The method comprises the following procedures. A video signal specification is obtained and a color space of a plasma display panel is measured. Deviations between the color space of the plasma display panel and a specification color space of the video signal specification are calculated. A color space transformation matrix is formed and image display signals are provided. The color space of the plasma display panel is transformed into a transformed color space according to the color space transformation matrix. The image display signals are modified to fit the transformed color space. The modified image display signals are shown on the plasma display panel. The method further comprises enhancement of the modified image display signals with an error diffusion method.

Hence, the plasma display panel with a color space transformation device and the color space transformation method according to the present invention effectively adjusts the color space of the plasma display panel to demonstrate a high quality video image and effectively to reduce the color deviation caused by different video image specifications. Moreover, if there is a technology that will change the color space of the plasma display panel, the plasma display panel only needs to input the new color space transformation coefficient matrix into the digital board of the plasma display panel so that the plasma display panel can demonstrate the video image according to the new color space transformed into specified video color space.

BRIEF DESCRIPTION OF THE DRAWINGS

The foregoing aspects and many of the attendant advantages of this invention will be more readily appreciated as the same becomes better understood by reference to the following detailed description, when taken in conjunction with the accompanying drawings, wherein.

DETAILED DESCRIPTION OF THE PREFERRED EMBODIMENT

The following description is the best presently contemplated mode of carrying out the present invention. This description is not to be taken in a limiting sense but is made merely for the purpose of describing the general principles of the invention. The scope of the invention should be determined by referencing the appended claims.

Figure 1:
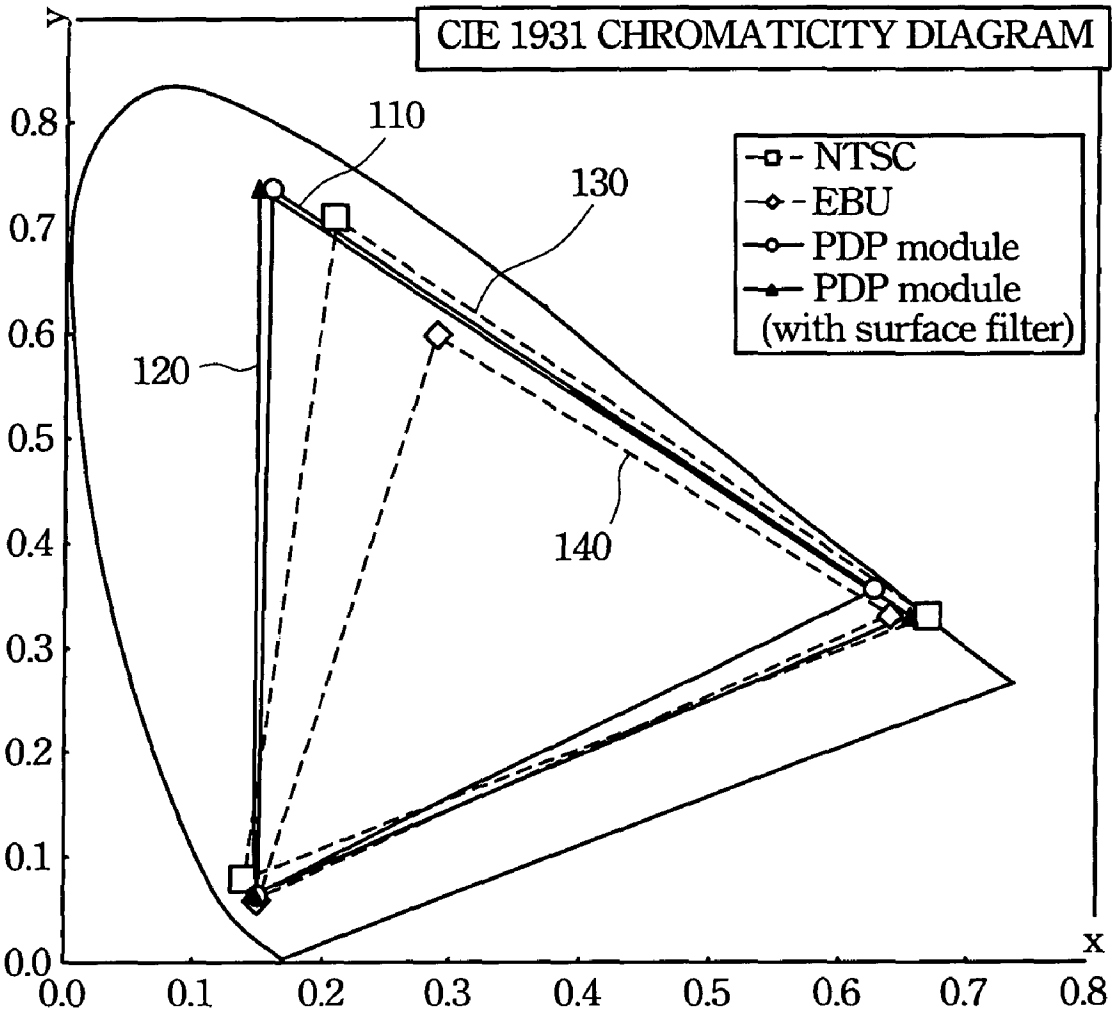
Fig. 1 (PRIOR ART)
FIG. 1 is a CIE 1931 chromaticity diagram with color spaces of NTSC, EBU, and PDP module.
Figure 2:
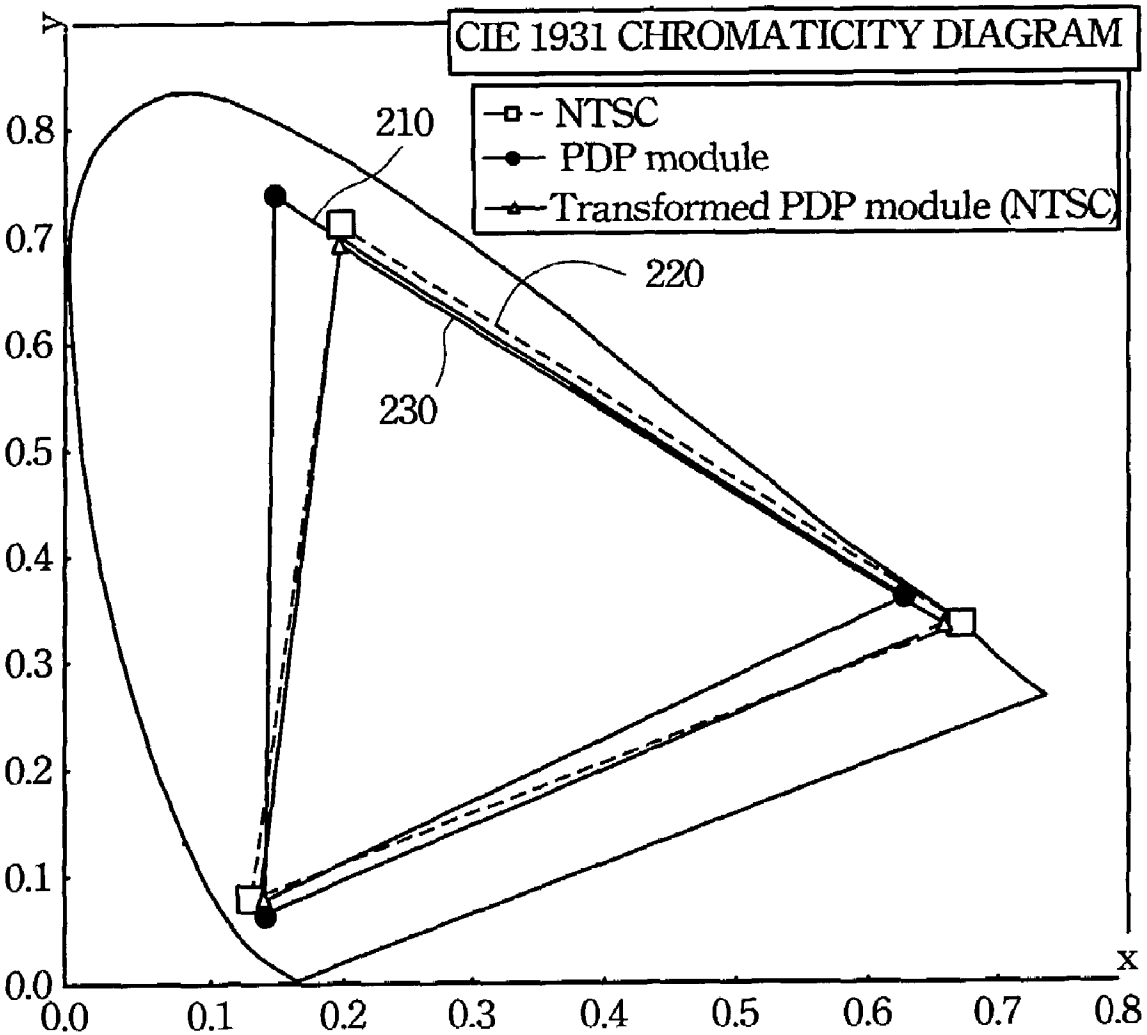
FIG. 2 is a color space comparison for a transformed PDP module according to the NTSC specification, the PDP module and the NTSC specification in the CIE 1931 chromaticity diagram.
Figure 3:
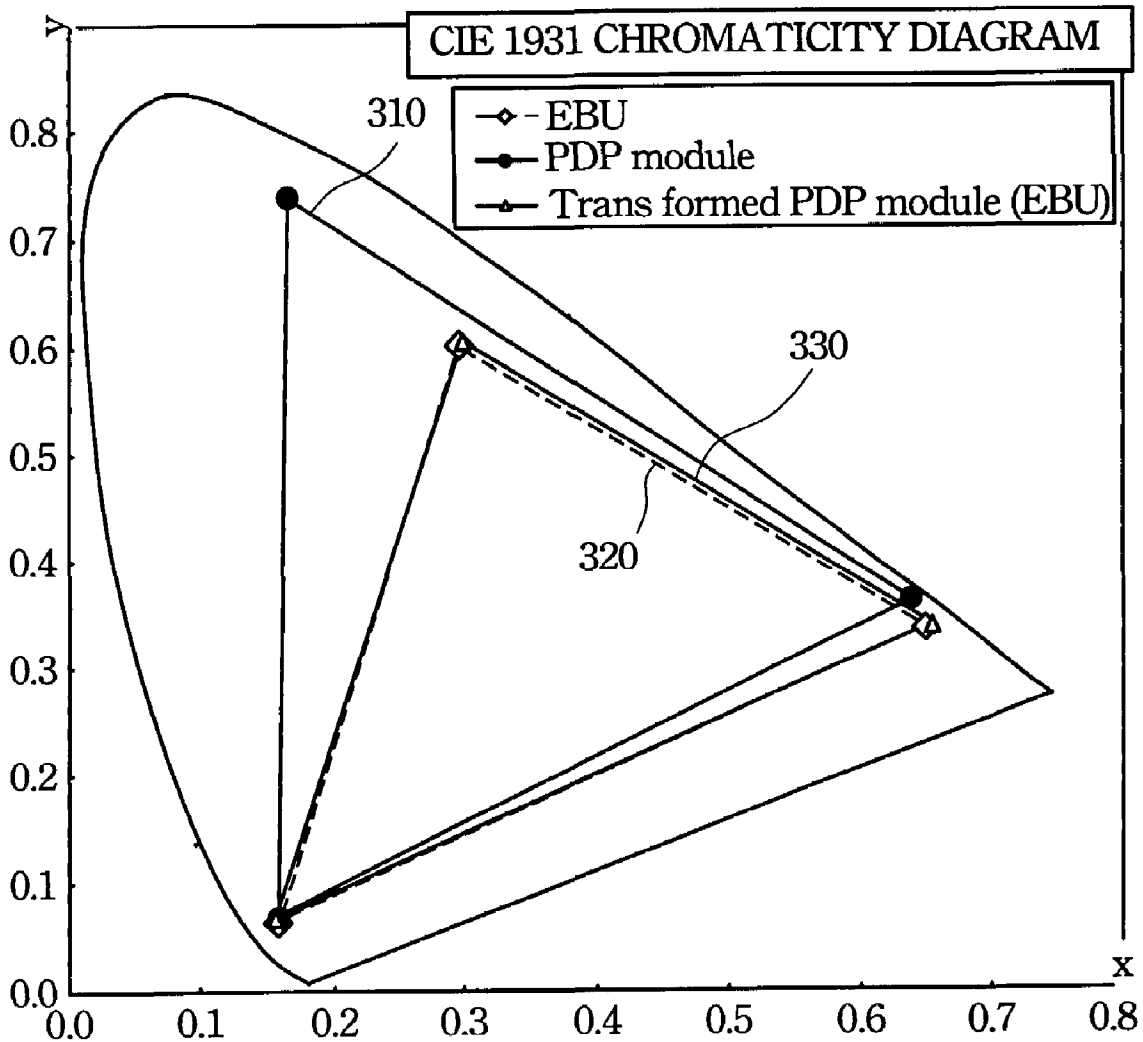
FIG. 3 is a color space comparison for a transformed PDP module according to the EBU specification, the PDP module and the EBU specification in the CIE 1931 chromaticity diagram.

FIG. 2 is a color space comparison for a transformed PDP module according to the NTSC specification, the PDP module and the NTSC specification in the CIE 1931 chromaticity diagram. FIG. 3 is a color space comparison for a transformed PDP module according to the EBU specification, the PDP module and the EBU specification in the CIE 1931 chromaticity diagram. Referring to the comparison result, the plasma display panel module with a transformation device according to the present invention can easily satisfy the video specification of the NTSC and EBU. Furthermore, the plasma display panel module with a transformation device according to the present invention can simulate any predetermined color space of the video specification to transform the color space of the plasma display panel module to demonstrate the image according to the video specification. The following description detailed explains the feature and spirit of the present invention with detailed embodiment and exemplary data thereof. The exemplary data and explanation are given to illustrate the characteristic and spirit of the present rather than to limit the present invention.

The present invention utilizes the color space transformation to resolve differences between the PDP module color space and video specification color space. First, the present invention utilizes the Grassman's Law of Color Mixture to calculate the relationship between the RGB display capabilities of the PDP module and the video specification of NTSC/EBU/sRGB. The digital circuit of the PDP module builds up an instant look-up transformation table after actual measurement and calculation so that the color and gray level of the output image of the PDP module can be appropriately adjusted by the color space transformation device. Therefore, the plasma display panel with the color space transformation device according to the present invention can simulate the color space of any predetermined video specification to output an optimum color according to the predetermined video specification and reduce the color deviation therebetween.

The color space transformation starts from measuring the RGB colors of the PDP module and comparing the same with the video specification requirement. The digital circuit establishes a look-up table to transform the output color and gray level of the PDP module to fit an accurate color space with a suitable transformation collocation.

For example, while video input signal format is NTSC, the RGB chromaticity of NTSC specification are $Rn(x_{rn}, y_{rn})$, $Gn(x_{gn}, y_{gn})$, $Bn(x_{bn}, y_{bn})$ and the RGB chromaticity of the PDP module are $Rp(x_{rp}, y_{rp})$, $Gp(x_{gp}, y_{gp})$, and $Bp(x_{bp}, y_{bp})$. Therefore, the color space transformation is necessary for using the PDP module to demonstrate the NTSC video input signal. 1 luminance unit of Rn can be replaced by 1 luminance unit of Rp combined with $m_{rg}$ luminance unit of Gp and $m_{rb}$ luminance unit of Bp as illustrated by the following equations (1) and (2):

$$Rn=m_{rr}\cdot Rp+m_{rg}\cdot Gp+m_{rb}\cdot Bp \tag{1}$$

$$m_{rr}=1.0 \tag{2}$$

According to the Grassman's Law of Color Mixture, the Rn coordinate value can therefore be represented by the chromaticity value and the luminance of the Rp, Gp, and Bp. Hence, the equation (1) can be rewritten as the following equations (3) and (4):

$$x_m=\frac{\frac{m_{rr}\cdot Y_{rp}\cdot x_{rp}}{y_{rp}}+\frac{m_{rg}\cdot Y_{gp}\cdot x_{gp}}{y_{gp}}+\frac{m_{rb}\cdot Y_{bp}\cdot x_{bp}}{y_{bp}}}{\frac{m_{rr}\cdot Y_{rp}}{y_{rp}}+\frac{m_{rg}\cdot Y_{gp}}{y_{gp}}+\frac{m_{rb}\cdot Y_{bp}}{y_{bp}}} \tag{3}$$

$$y_m=\frac{m_{rr}\cdot Y_{rp}+m_{rg}\cdot Y_{gp}+m_{rb}\cdot Y_{bp}}{\frac{m_{rr}\cdot Y_{rp}}{y_{rp}}+\frac{m_{rg}\cdot Y_{gp}}{y_{gp}}+\frac{m_{rb}\cdot Y_{bp}}{y_{bp}}} \tag{4}$$

where $Y_{rp}+Y_{gp}+Y_{bp}=1.0$ and $Y_{rp}$, $Y_{gp}$, and $Y_{bp}$ are the luminance ratio of the PDP module in a same driving condition.

Because the RGB chromaticity values of the NTSC specification are known and the RGB chromaticity values and luminance ratios of the PDP module are measured, the value of $m_{rr}$, $m_{rg}$, $m_{rb}$ can be found with equations (2)–(4).

With the same idea, if 1 luminance unit of Gn can be replaced by the $m_{gr}$ luminance unit of Rp combined with 1 luminance unit of Gp and $m_{gb}$ luminance unit of Bp and 1 luminance unit of Bn can be replaced by the $m_{br}$ luminance unit of Rp combined with $m_{bg}$ luminance unit of Gp and 1 luminance unit of Bp, the color space transformation can be represented by the following equations:

$$Gn=m_{gr}\cdot Rp+m_{gg}\cdot Gp+m_{gb}\cdot Bp$$

$$m_{gg}=1.0$$

$$Bn=m_{br}\cdot Rp+m_{bg}\cdot Gp+m_{bb}\cdot Bp$$

$$m_{bb}=1.0$$

By substituting these four equations into equations (1) and (2), the color space transformation can be represented by the following matrix:

$$\begin{bmatrix} Rn \\ Gn \\ Bn \end{bmatrix}_{(x,y)} = \begin{bmatrix} m_{rr} & m_{rg} & m_{rb} \\ m_{gr} & m_{gg} & m_{gb} \\ m_{br} & m_{bg} & m_{bb} \end{bmatrix} \begin{bmatrix} Rp \\ Gp \\ Bp \end{bmatrix}_{(x,y)} \tag{5}$$

where $$\begin{bmatrix} m_{rr} & m_{rg} & m_{rb} \\ m_{gr} & m_{gg} & m_{gb} \\ m_{br} & m_{bg} & m_{bb} \end{bmatrix} = \begin{matrix}\text{Color space transformation} \\ \text{coefficients}\end{matrix} = [M]$$

and $$m_{rr} = m_{gg} = m_{bb} = 1.0 \tag{6}$$

The coefficients matrix [M] can be solved by calculation. If the gray levels of Rn, Gn, and Bn of an NTSC image are (r, g, b), the gray levels (R, G, B) of the PDP module output image fulfill the following equation:

$$\begin{aligned} & R\cdot Rp + G\cdot Gp + B\cdot Bp \\ & = r\cdot Rn + g\cdot Gn + b\cdot Bn \\ & = [\,r \quad g \quad b\,]\begin{bmatrix} Rn \\ Gn \\ Bn \end{bmatrix} \\ & = [\,r \quad g \quad b\,]\begin{bmatrix} m_{rr} & m_{rg} & m_{rb} \\ m_{gr} & m_{gg} & m_{gb} \\ m_{br} & m_{bg} & m_{bb} \end{bmatrix}\begin{bmatrix} Rp \\ Gp \\ Bp \end{bmatrix} \\ & = (r\cdot m_{rr} + g\cdot m_{gr} + b\cdot m_{br})\cdot Rp + \\ & \quad (r\cdot m_{rg} + g\cdot m_{gg} + b\cdot m_{bg})\cdot Gp + \\ & \quad (r\cdot m_{rb} + g\cdot m_{gb} + b\cdot m_{bb})\cdot Bp \end{aligned} \tag{7}$$

Therefore, the gray levels, (R, G, B), of the output image can be represented by following equation:

$$R=r\cdot m_{rr}+g\cdot m_{gr}+b\cdot m_{br}$$

$$G=r\cdot m_{rg}+g\cdot m_{gg}+b\cdot m_{bg}$$

$$B=r\cdot m_{rb}+g\cdot m_{gb}+b\cdot m_{bb} \tag{8}$$

With the same reason, the color space transformation coefficients between EBU or sRGB vs. PDP module can be obtained. Therefore, the relation equation of PDP module output gray levels (R, G, B) vs. input gray levels (r, g, b) is found and established in the digital circuit of image processing unit of the PDP module to achieve the objective of color space transformation.

As described above, a PDP set normally adds a surface filter for reducing electromagnetic radiation, filtering out the reddish orange light, and transforming output image color and protecting the PDP panel. Table 1 is a chromaticity purity comparison table for the NTSC specification, EBU specification, sRGB specification, PDP module, and PDP module with surface filter. Table 2 is measured data of the RGB chromaticity value and luminance of the PDP module with surface filter. Table 3 is the luminance ratio of the PDP module in the same driving condition.

TABLE 1

Chromaticity Purity Comparison

| | R | | G | | B | |
|---|---|---|---|---|---|---|
| | x | y | x | y | x | y |
| NTSC | 0.67 | 0.33 | 0.21 | 0.71 | 0.14 | 0.08 |
| EBU | 0.64 | 0.33 | 0.29 | 0.60 | 0.15 | 0.06 |
| sRGB | 0.64 | 0.33 | 0.30 | 0.60 | 0.15 | 0.06 |
| PDP module | 0.6286 | 0.3552 | 0.1605 | 0.7363 | 0.1505 | 0.0639 |
| PDP module (with surface filter) | 0.6560 | 0.3306 | 0.1491 | 0.7376 | 0.1482 | 0.0660 |

TABLE 2

Measured Data of the RGB Chromaticity Value and Luminance of the PDP Module with Surface Filter

| | Rp | | Gp | | Bp | |
|---|---|---|---|---|---|---|
| | $x_{rp}$ | $y_{rp}$ | $x_{gp}$ | $y_{gp}$ | $x_{bp}$ | $y_{bp}$ |
| Chromaticity | 0.6560 | 0.3306 | 0.1491 | 0.7376 | 0.1482 | 0.0660 |
| Luminance (nit) | 52.77 | | 117.4 | | 23.61 | |

TABLE 3

Luminance Ratio of the PDP Module

| | $Y_{rp}$ | $Y_{gp}$ | $Y_{bp}$ |
|---|---|---|---|
| Luminance Ratio | 0.2723 | 0.6058 | 0.1218 |

By substituting data from Table 1, Table 2, and Table 3 into equations (5) and (6), the coefficient matrix [M] of the PDP module for various color space transformation can be obtained as illustrated in Table 4.

TABLE 4

Color Space Transformation Coefficient Matrix [M]

| | $Rn = m_{rr} \cdot Rp + m_{rg} \cdot Gp + m_{rb} \cdot Bp$ | | | $Gn = m_{gr} \cdot Rp + m_{gg} \cdot Gp + m_{gb} \cdot Bp$ | | | $Bn = m_{br} \cdot Rp + m_{bg} \cdot Gp + m_{bb} \cdot Bp$ | | |
|---|---|---|---|---|---|---|---|---|---|
| | $m_{rr}$ | $m_{rg}$ | $m_{rb}$ | $m_{gr}$ | $m_{gg}$ | $m_{gb}$ | $m_{br}$ | $m_{bg}$ | $m_{bb}$ |
| NTSC → PDP | 1.000 | −0.011 | −0.007 | 0.131 | 1.000 | −0.015 | −0.037 | 0.062 | 1.000 |
| EBU → PDP | 1.000 | 0.012 | 0.009 | 0.404 | 1.000 | 0.024 | 0.008 | −0.023 | 1.000 |
| SRGB → PDP | 1.000 | 0.012 | 0.009 | 0.438 | 1.000 | 0.016 | 0.008 | −0.023 | 1.000 |

By substituting coefficient data in Table 4 into equation (8), transformation relation equations of the corresponding PDP gray level (R, G, B) can be obtained from the original video input signal gray level (r, g, b) with color space transformation coefficient. Table 5 is the transformation relation equations of the corresponding PDP module gray level with the video input gray level for the preferred embodiment.

TABLE 5

Corresponding Transformation Relation Equations

| | PDP output | | |
|---|---|---|---|
| Video input | PDP - R $r \cdot m_{rr} + g \cdot m_{gr} + b \cdot m_{br}$ | PDP - G $r \cdot m_{rg} + g \cdot m_{gg} + b \cdot m_{bg}$ | PDP - B $r \cdot m_{rb} + g \cdot m_{gb} + b \cdot m_{bb}$ |
| NTSC (r, g, b) | 1.000 r + 0.131 g − 0.037 b | −0.011 r + 1.000 g + 0.062 b | −0.007 r − 0.015 g + 1.000 b |
| EBU (r, g, b) | 1.000 r + 0.404 g + 0.008 b | 0.012 r + 1.000 g − 0.023 b | 0.009 r + 0.024 g + 1.000 b |
| sRGB (r, g, b) | 1.000 r + 0.438 g + 0.008 b | 0.012 r + 1.000 g − 0.023 b | 0.009 r + 0.016 g + 1.000 b |

By substituting an exemplary input signal gray level (100, 150, 200) into Table 5, Table 5 can be reduced into Table 6.

TABLE 6

Corresponding Transformation Value

| | PDP output | | |
|---|---|---|---|
| Video input | PDP - R | PDP - G | PDP - B |
| NTSC (100, 150, 200) | 112 | 161 | 197 |
| EBU (100, 150, 200) | 162 | 147 | 205 |
| sRGB (100, 150, 200) | 167 | 147 | 203 |

By substituting gray level 255 into Table 5, the pure RGB color gray level of NTSC and EBU can be transformed into the corresponding gray level of PDP module as shown in Table 7.

TABLE 7

Corresponding Transformation Value of Pure RGB

| | PDP output | | |
|---|---|---|---|
| Video input | PDP - R | PDP - G | PDP - B |
| NTSC - R (255, 0, 0) | 255 | −3 | −2 |
| NTSC - G (0, 255, 0) | 33 | 255 | −4 |

TABLE 7-continued

Corresponding Transformation Value of Pure RGB

| | PDP output | | |
|---|---|---|---|
| Video input | PDP - R | PDP - G | PDP - B |
| NTSC - B (0, 0, 255) | −9 | 16 | 255 |
| EBU - R (255, 0, 0) | 255 | 3 | 2 |

TABLE 7-continued

Corresponding Transformation Value of Pure RGB

| | PDP output | | |
|---|---|---|---|
| Video input | PDP - R | PDP - G | PDP - B |
| EBU - G (0, 255, 0) | 103 | 255 | 6 |
| EBU - B (0, 0, 255) | 2 | −6 | 255 |

If the transformed value is less than 0, the value is replaced by 0 in Table 7. Table 8 represents transformed color space of the PDP module vs. various video image specifications.

TABLE 8

Chromaticity Purity Comparison

| | R | | G | | B | |
|---|---|---|---|---|---|---|
| | X | y | x | y | x | y |
| NTSC Spec. | 0.67 | 0.33 | 0.21 | 0.71 | 0.14 | 0.08 |
| EBU Spec. | 0.64 | 0.33 | 0.29 | 0.60 | 0.15 | 0.06 |
| PDP module | 0.6286 | 0.3552 | 0.1605 | 0.7363 | 0.1505 | 0.0639 |
| PDP module (With Surface Filter) | 0.6560 | 0.3306 | 0.1491 | 0.7376 | 0.1482 | 0.0660 |

TABLE 8-continued

| | Chromaticity Purity Comparison | | | | | |
|---|---|---|---|---|---|---|
| | R | | G | | B | |
| | X | y | x | y | x | y |
| Transformed PDP module (NTSC) | 0.6585 | 0.3302 | 0.2076 | 0.6899 | 0.1476 | 0.0806 |
| Transformed PDP module (EBU) | 0.6446 | 0.3326 | 0.2930 | 0.6030 | 0.1492 | 0.0656 |

The data of Table 8 is sketched in the CIE 1931 chromaticity diagram to obtain FIG. 2 and FIG. 3. The overlapping region of the color space of the transformed PDP module on the color space of the NTSC specification is about 93.5% and on the color space of the EBU specification is about 98.5%. Furthermore, the color deviation therebetween is obviously reduced. Referring to FIG. 2, the region 210 represents the color space of PDP module, the region 220 represents the color space of NTSC specification, the region 230 represents the color space of transformed PDP module according to NTSC specification. Referring to FIG. 3, the region 310 represents the color space of PDP module, the region 320 represents the color space of EBU specification, the region 330 represents the color space of transformed PDP module according to EBU specification. Therefore, the PDP with a color space transformation device according to the present invention can directly receive video image signals from NTSC and EBU and transform these signals into optimum image output signals in an optimum color space of the PDP module to reduce effectively the color deviation for the PDP module display. The PDP with a color space transformation device according to the present invention can also be implemented in any other video image signal transformation after the transformation coefficients of the video specification are input into the color space transformation device. Therefore, the PDP with a color space transformation device according to the present invention can demonstrate the optimum color and white balance.

Figure 4:
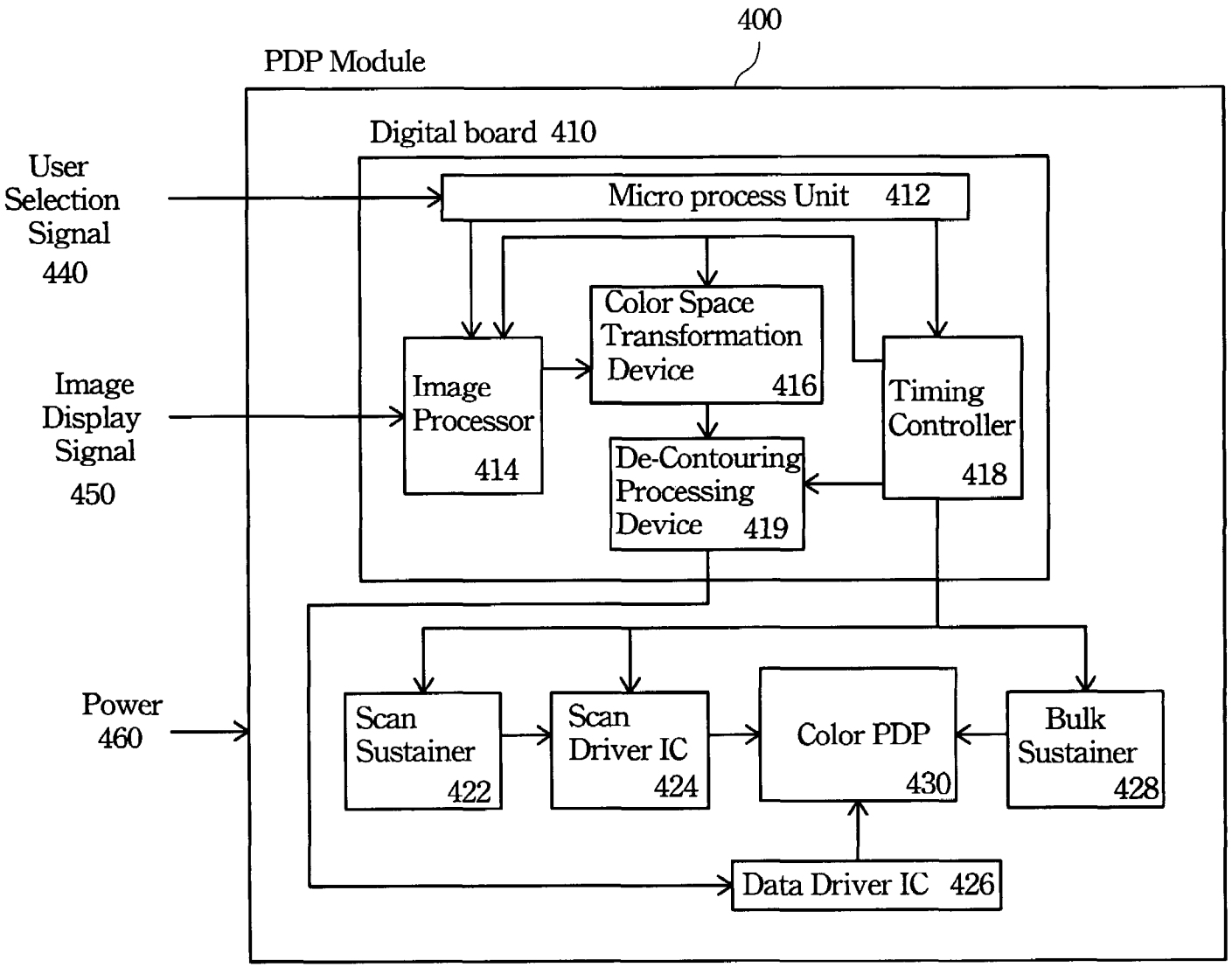
FIG. 4 is a block diagram of the PDP module with a color space transformation device according to the present invention.

FIG. 4 is a block diagram of the PDP module with a color space transformation device according to the present invention. The PDP module 400 includes a digital board 410, a scan sustainer 422, a scan driver IC 424, a color plasma display panel 430, a bulk sustainer 428, and a data driver IC 426. The digital board 410 further includes a microprocessor unit 412, an image processor 414, a color space transformation device 416, a de-contouring processing device 419, and a timing controller 418. The microprocessor unit 412 receives user selection signals 440 to adjust manually the color space of the output image of the PDP module 400. The image processor 414 receives image display signals 450 such as the NTSC image display signals or the EBU image display signals. The power 460 provides the power for the PDP module 400. Further, the scan sustainer 422, the scan driver IC 424, the color plasma display panel 430, the bulk sustainer 428, and the data driver IC 426 constitute the image displaying device and the control circuit thereof.

The image processor 414 of the PDP module 400 receives the image display signal 450 and the color space transformation device 416 transforms the same into a suitable image output signal according to the user selection signal 440. The suitable image output signal is further processed by the de-contouring processing device 419 and sent to the data driver IC 426. With the control of the scan sustainer 422, the scan driver IC 424, and the bulk sustainer 428 coupling with the timing controller 418, the color plasma display panel 430 then shows the suitable image output signal thereon. The timing controller 418 provides timing signals for the PDP module 400 timing control.

The PDP with a color space transformation device according to the present invention further utilizes the de-contouring processing device 419 to process the image with an error diffusion method to enhance image resolution so that the output image is more detailed and color is more uniform. Because the PDP module according to the present invention directly transforms the color space therein, the PDP module can utilize more than 8 bits to process image data, such as 10 bits, 15 bits, or more than 15 bits, effectively to enhance the image resolution and precision. Therefore, the present invention can display the gray level value small than one. Furthermore, the PDP module directly transforms the color space in the module so that the PDP module can accurately display any video image according to predetermined video specification to demonstrate the video image in an optimum color space.

The color space transformation coefficient matrix according to the present invention is stored in a memory of the digital image processing circuit, and therefore even many color space transformation coefficient matrices according to many video specification can be stored in the same circuit. The PDP module according to the present invention can therefore automatically detects the video specification or manually switches the video specification to fit the user's requirements and the different user region requirement. Even if a new video specification is created, the PDP according to the present invention still can transform the new video image into a suitable image output according to the new video specification after the new color space transformation coefficient matrix is stored in the memory of the digital circuit.

Even if a new phosphorus, new surface filter, or any new color space is implemented, the PDP according to the present invention can still provide a suitable color space to output the video image after the new color space transformation coefficient matrix is stored in the memory of the digital circuit.

As is understood by a person skilled in the art, the foregoing preferred embodiments of the present invention are illustrative of the present invention rather than limiting of the present invention. It is intended that various modifications and similar arrangements be included within the spirit and scope of the appended claims, the scope of which should be accorded the broadest interpretation so as to encompass all such modifications and similar structures.

What is claimed is:

1. A plasma display panel with a color space transformation device, comprising:

a digital board comprising a color space transformation device, the digital board receiving image display signals and processing the image display signals, the color space transformation device transforming a color space of the plasma display panel into a transformed color space of the plasma display panel according to a specification of the image display signals and transforming the image display signals into transformed image display signals according to the transformed color space of the plasma display panel;

a display control circuit connected to the digital board to receive the transformed image display signals from the digital board and generate control signals; and a color plasma display panel receiving the control signals and the transformed image display signals, and displaying the transformed image display signals on the color plasma display panel with the transformed color space according to the control signals.

2. The plasma display panel with a color space transformation device of claim 1, wherein the digital board comprises:

a microprocessor unit receiving a user selection signal and issuing a request to change the color space of the plasma display panel according to the user selection signal; and an image processor coupling with the microprocessor unit to receive the request and the image display signals and transfer the request and the image display signals to the color space transformation device.

3. The plasma display panel with a color space transformation device of claim 2, wherein the digital board further comprises a de-contouring processing device coupling between the color space transformation device and the display control circuit to process the transformed image display signals with an error diffusion method to enhance a resolution of the transformed image display signals.

4. The plasma display panel with a color space transformation device of claim 1, wherein the specification of the image display signals comprises a National Television System Committee (NTSC) specification.

5. The plasma display panel with a color space transformation device of claim 1, wherein the specification of the image display signals comprises a European Broadcasting Union (EBU) specification.

6. The plasma display panel with a color space transformation device of claim 1, wherein the display control circuit further comprises:

a scan sustainer coupling between the digital board and the color plasma display panel;

a scan driver integrated circuit coupling between the scan sustainer and the color plasma display panel;

a bulk sustainer coupling between the digital board and the color plasma display panel, wherein the scan sustainer, the scan driver integrated circuit, and the bulk sustainer generate the control signals to control the color plasma display panel; and a data driver integrated circuit coupling between the digital board and the color plasma display panel to receive the transformed image display signals and transmit to the color plasma display panel.

7. The plasma display panel with a color space transformation device of claim 1, wherein the digital board further comprises a timing controller to provide timing signals for the digital board and the display control circuit.

8. The plasma display panel with a color space transformation device of claim 1, wherein the color plasma display panel further comprises a surface filter to filter a reddish orange light generated by a gas discharge.

9. A color space transformation method comprising:

obtaining a video signal specification;

measuring a color space of a plasma display panel;

calculating deviations between the color space of the plasma display panel and a specification color space of the video signal specification;

forming a color space transformation matrix;

providing image display signals;

transforming the color space of the plasma display panel into a transformed color space according to the color space transformation matrix;

modifying the image display signals to fit the transformed color space; and displaying the modified image display signals on the plasma display panel.

10. The color space transformation method of claim 9, wherein after the step of displaying the modified image display signals on the plasma display panel further comprises a step of enhancing the modified image display signals with an error diffusion method.

11. The color space transformation method of claim 9, wherein the video signal specification comprises a National Television System Committee (NTSC) specification.

12. The color space transformation method of claim 9, wherein the video signal specification comprises a European Broadcasting Union (EBU) specification.

13. The color space transformation method of claim 9, wherein the plasma display panel further comprises a surface filter to filter a reddish orange light generated by a gas discharge.

14. A plasma display panel with a color space transformation device comprising:

a color plasma display panel;

a digital board, the digital board comprising:

an image processor receiving image display signals;

a color space transformation device receiving the image display signals from the image processor, the color space transformation device transforming a color space of the color plasma display panel into a transformed color space according to a specification of the image display signals and transforming the image display signals to transformed image display signals for complying with the transformed color space; and a display control circuit, the display control circuit comprising:

a scan sustainer coupling between the digital board and the color plasma display panel;

a scan driver integrated circuit coupling between the scan sustainer and the color plasma display panel;

a bulk sustainer coupling between the digital board and the color plasma display panel, wherein the scan sustainer, the scan driver integrated circuit, and the bulk sustainer generate control signals to control the color plasma display panel; and a data driver integrated circuit coupling between the digital board and the color plasma display panel to receive the transformed image display signals and transmit to the color plasma display panel.

15. The plasma display panel with a color space transformation device of claim 14, wherein the digital board further comprises a microprocessor unit receiving a user selection signal and issuing a request to change the color space of the plasma display panel according to the user selection signal.

16. The plasma display panel with a color space transformation device of claim 15, wherein the digital board further comprises a de-contouring processing device coupling between the color space transformation device and the display control circuit to process the transformed image display signals with an error diffusion method to enhance a resolution of the transformed image display signals.

17. The plasma display panel with a color space transformation device of claim 14, wherein the specification of the image display signals comprises a National Television System Committee (NTSC) specification.

18. The plasma display panel with a color space transformation device of claim 14, wherein the specification of the image display signals comprises a European Broadcasting Union (EBU) specification.

19. The plasma display panel with a color space transformation device of claim 14, wherein the digital board further comprises a timing controller to provide timing signals for the digital board and the display control circuit.

20. The plasma display panel with a color space transformation device of claim 14, wherein the color plasma display panel further comprises a surface filter to filter a reddish orange light generated by a gas discharge.

* * * * *